US008151984B2

(12) United States Patent
Braeder et al.

(10) Patent No.: US 8,151,984 B2
(45) Date of Patent: Apr. 10, 2012

(54) DISPENSING DEVICE

(75) Inventors: D'art Daniel David Braeder, Metro Manila (PH); John McBrien Levey, New South Wales (AU); David Fulton Francis, New South Wales (AU); Clive Steven Solari, New South Wales (AU)

(73) Assignee: Epodpak International, Inc., Manila (PH)

( * ) Notice: Subject to any disclaimer, the term of this patent is extended or adjusted under 35 U.S.C. 154(b) by 231 days.

(21) Appl. No.: 10/598,733

(22) PCT Filed: Mar. 9, 2005

(86) PCT No.: PCT/AU2005/000327

§ 371 (c)(1),
(2), (4) Date: Jul. 25, 2007

(87) PCT Pub. No.: WO2005/087614

PCT Pub. Date: Sep. 22, 2005

(65) Prior Publication Data

US 2008/0116097 A1 May 22, 2008

(30) Foreign Application Priority Data

Mar. 11, 2004 (AU) ..... 2004901278

(51) Int. Cl.
*B65D 25/08* (2006.01)
*B65D 73/00* (2006.01)

(52) U.S. Cl. ..... 206/219; 206/462; 206/469; 206/568

(58) Field of Classification Search ..... 206/462, 206/219, 469, 604, 568
See application file for complete search history.

(56) References Cited

U.S. PATENT DOCUMENTS

| | | | | | |
|---|---|---|---|---|---|
| 2,325,921 | A | | 10/1942 | Salfisberg | |
| 3,074,544 | A | * | 1/1963 | Bollmeier et al. | 206/219 |
| 3,224,640 | A | | 12/1965 | Schneider et al. | |
| 3,383,260 | A | | 5/1968 | Mojonnier | |
| 3,521,805 | A | | 7/1970 | Ward | |
| 4,176,567 | A | * | 12/1979 | Weisberg | 83/30 |
| 4,790,429 | A | | 12/1988 | Fukushima | |
| 4,805,767 | A | | 2/1989 | Newman | |
| 4,903,842 | A | * | 2/1990 | Tokuda et al. | 229/123.1 |
| 5,395,031 | A | * | 3/1995 | Redmond | 222/541.6 |
| 5,881,869 | A | | 3/1999 | Hudson | |
| 6,612,769 | B2 | * | 9/2003 | Lee et al. | 401/183 |
| 7,241,066 | B1 | * | 7/2007 | Rosen et al. | 401/183 |
| 7,625,114 | B2 | * | 12/2009 | Suchan et al. | 366/130 |
| 2003/0075561 | A1 | * | 4/2003 | Pieri | 222/94 |

FOREIGN PATENT DOCUMENTS

| | | | | |
|---|---|---|---|---|
| DE | 20309546 | U1 | | 10/2003 |
| FR | 2644141 | A1 | | 9/1990 |
| JP | 04-006066 | A | | 1/1992 |
| JP | 3059476 | U | * | 3/1999 |
| JP | 3059476 | U | | 3/1999 |

* cited by examiner

*Primary Examiner* — Jila Mohandesi
*Assistant Examiner* — Sharon M Prange
(74) *Attorney, Agent, or Firm* — Lowe Hauptman Ham & Berner LLP

(57) ABSTRACT

A dispensing device (1) for separately storing two substances, adapted to dispense and apply proportional amounts of said substances, said device (1) comprising a longitudinal axis (3) about which two receptacles (4, 4'), composed of a flexible material, are disposed, each receptacle (4, 4'), containing one of said two substances and comprising an outlet (5) through winch said substance can be squeezed, said dispensing device (1) being adapted to be folded about the longitudinal axis (3).

15 Claims, 4 Drawing Sheets

DISPENSING DEVICE

RELATED APPLICATIONS

The present application is a National Phase entry of International Application Number PCT/AU2005/000327, filed Mar. 9, 2005, which claims priority from, Australian Application Number 2004901278, filed Mar. 11, 2004, the disclosure of which is hereby incorporated by reference herein in its entirety.

TECHNICAL FIELD

The present invention is directed to a dispensing device and, in particular, to a dispensing device for separately storing, dispensing and applying proportional amounts of two substances. The invention has been developed primarily for dispensing glue or adhesive in the form of an epoxy and a hardener and will be described with reference to this application. However, it will be appreciated that the invention is not limited to this particular field of use.

BACKGROUND OF THE INVENTION

Many devices are known which are useful for dispensing proportional amounts of two materials, typically epoxy and hardeners, kept separately prior to dispensing. Commonly, prior art devices comprise two collapsible tubes along with a means for holding the two tubes together. While the use of two tubes held together to dispense an epoxy and a hardener would appear to be effective, there are certain disadvantages. The use of a common sleeve or yoke to hold the devices together can interfere with the evacuation of the tubes. In addition, it is difficult to ensure that the proportional amounts of the substances within the tubes are dispensed. This is particularly the case when dispensing small amounts of the substances. Prior art devices are commonly provided for larger scale applications, meaning the tubes or containers holding the epoxy and hardener must be resealed after use. As a result blockage of the tube or dispensing device is common. This can render the glue unusable or difficult to apply in a consistent manner. There is therefore a need for a device for separating and dispensing epoxy and hardeners in a single use pack.

The device generally requires two hands for dispensing the contents. The distance between the nozzles of the two tubes can make proper mixing of the two substances difficult.

Prior art devices also include more complicated dispensing systems utilising air pressure or a displacement pump to remove epoxy and hardener from separate chambers. While many of these systems are effective, these machines are not intended for use in small applications and require significant outlay of money and investment of space and time.

It is an object of the invention to provide a dispensing device which will overcome or substantially ameliorate at least some of the deficiencies of the prior art, or to at least provide an alternative.

SUMMARY OF THE INVENTION

In one aspect of the present invention, there is provided a dispensing device for separately storing two substances, adapted to dispense and apply proportional amounts of said substances, said device comprising a longitudinal axis about which two receptacles, composed of a flexible material, are disposed, each receptacle containing one of said two substances and comprising an outlet through which said substance can be squeezed, said dispensing device being adapted to be folded about the longitudinal axis.

Preferably the receptacles are disposed such that one of said receptacles on one side of the longitudinal axis is a transposed mirror image of the other receptacle on the other side of the longitudinal axis, and said receptacles are substantially equidistant from the longitudinal axis.

Preferably the outlets include a weakened region which can comprise a scored or vacuum formed tear line or be adapted such that the substances contained within the receptacle will burst through the weakened region upon the receptacle being squeezed by a user.

Preferably the receptacles include indicia indicating where a thumb and forefinger should be positioned for use.

Preferably the dispensing device comprises two flexible laminae positioned adjacent one another and sealed together so as to define the two substance-containing receptacles.

Preferably the laminae are composed of different materials such as foil, polyethylene, polypropylene, polyvinyl chloride, polyvinyl acetate or foil coated with polypropylene.

Preferably the substances in the receptacles undergo a chemical or physical reaction upon mixing.

Preferably one receptacle contains an epoxy and the other receptacle contains a hardener. Alternately the receptacles contain foodstuffs, or pharmaceuticals, liquids, pastes or gels used in medical or dental work.

Preferably the dispensing device is adapted to be folded and manipulated by a user in a one-handed operation such that the outlets are easily aligned and the substances contained within the receptacles are simultaneously dispensed, mixed and proportionately applied.

Preferably the dispensing device is adapted to be used once and disposed of.

Preferably the outlets are positioned at or adjacent to the side edges of the dispensing device.

In a second aspect of the present invention, there is provided a dispensing device for separately storing an epoxy and a hardener, adapted to dispense, mix and apply proportional amounts of the epoxy and hardener, the device comprising a longitudinal axis about which two receptacles, composed of a flexible material, are disposed, each receptacle containing either epoxy or hardener and comprising an outlet through which the epoxy or hardener can be squeezed, the dispensing device being adapted to be folded about the longitudinal axis.

Preferably, the dispensing device is adapted to be folded and manipulated by a user in a one-handed operation such that the outlets are easily aligned and the epoxy and hardener are simultaneously dispensed, mixed and proportionately applied, such device is adapted to be used once and disposed of.

BRIEF DESCRIPTION OF THE DRAWING

A preferred embodiment of the invention will now be described, by way of example only, with reference to the accompanying figure in which.

BEST MODE OF CARRYING OUT THE INVENTION

Figure 1:
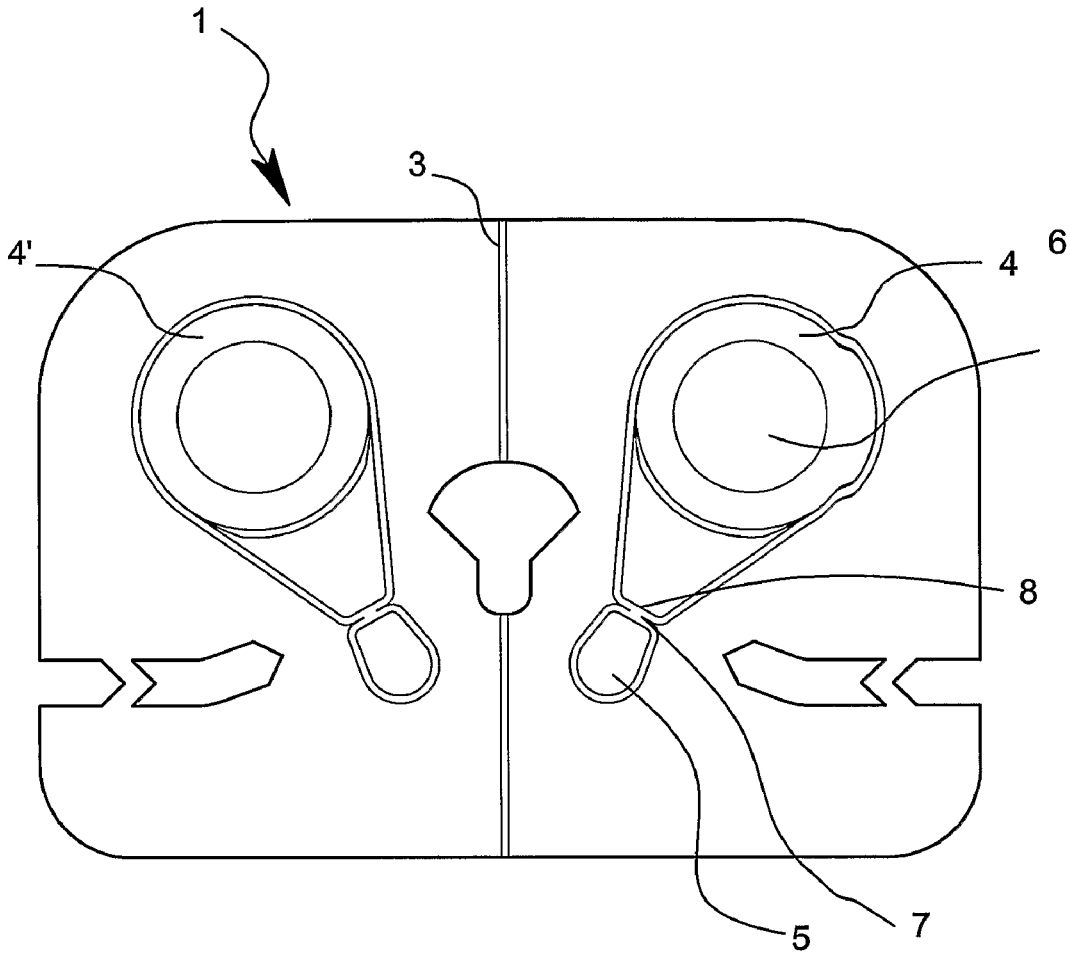
FIG. 1 is a plan view of a dispensing device in accordance with a preferred embodiment of the present invention.
Figure 2:
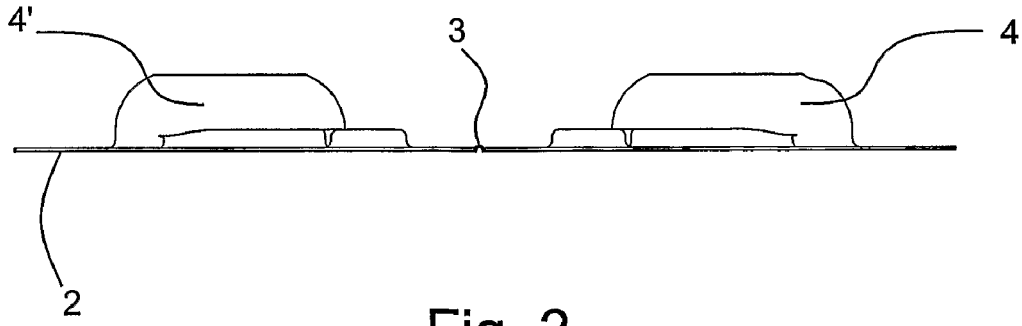
FIG. 2 is an elevation view of the dispensing device shown in FIG. 1.
Figure 3:
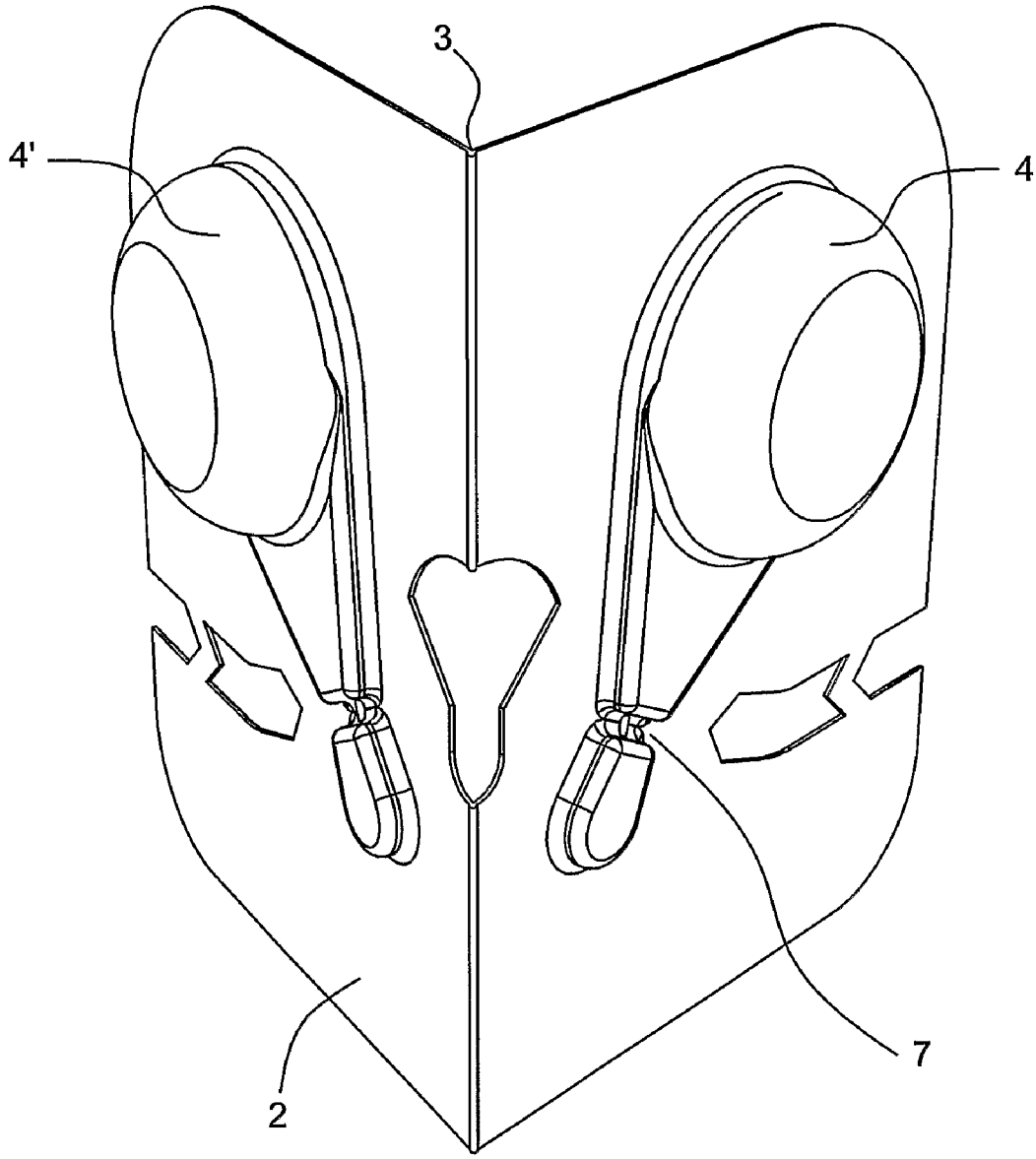
FIG. 3 is a perspective view of the dispensing device of FIG. 1 in a partially folded configuration.
Figure 4:
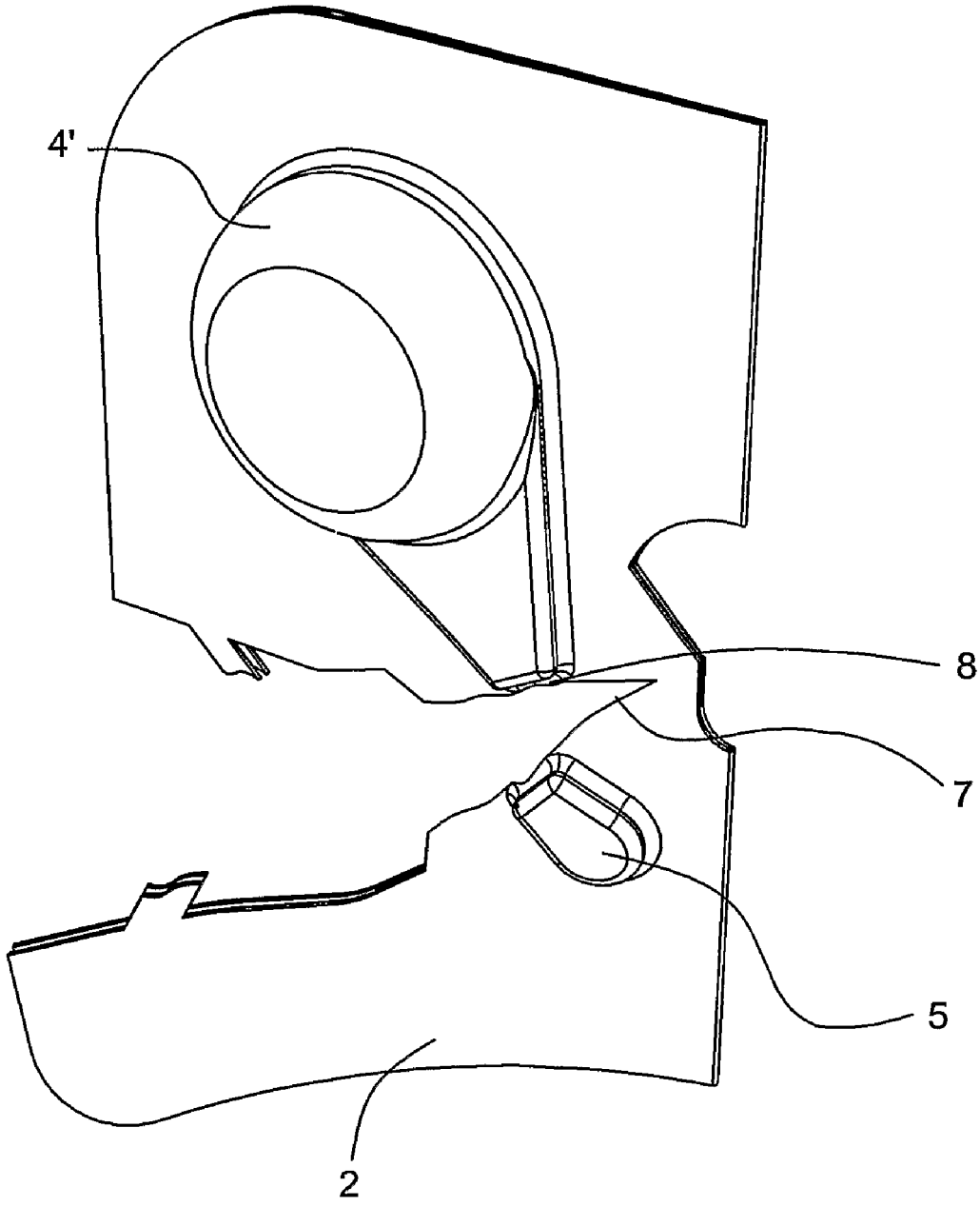
FIG. 4 is a perspective view of the dispensing device 1 of FIG. 1, in a folded configuration and torn open.
Figure 5:
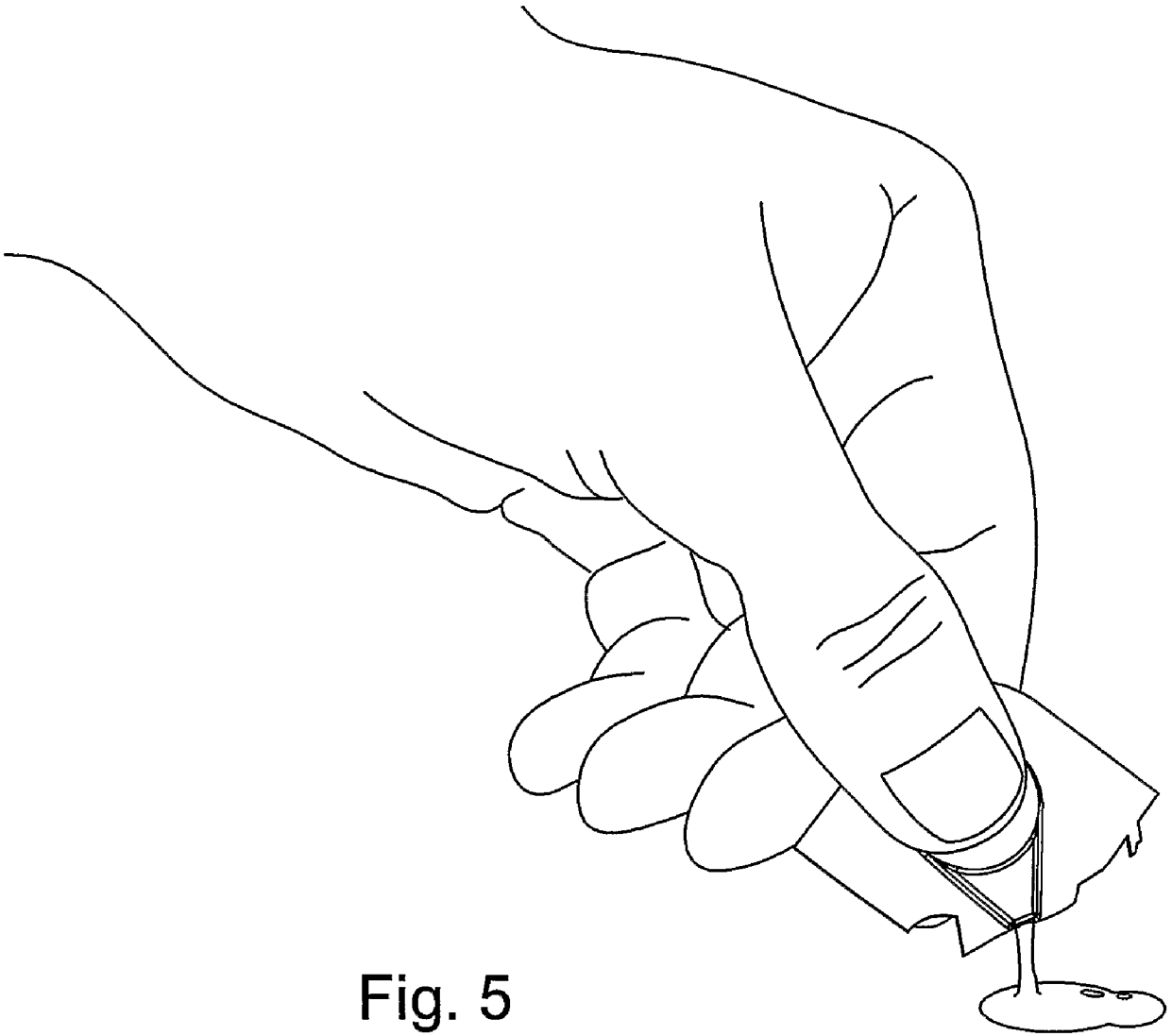
FIG. 5 is a perspective view of the dispensing device as a user squeezes it.

Referring to FIGS. 1-5, there is shown an embodiment of a dispensing device for separately storing two substances in accordance with the present invention. The device is adapted to dispense, mix and apply proportional amounts of the substances. The dispensing device 1 comprises a substantially flat thin flexible web 2. The web 2 includes a longitudinal axis 3 which is preferably scored or vacuum formed to enable a user to easily fold the dispensing device 1 about longitudinal axis 3.

Two receptacles 4 and 4' are disposed about longitudinal axis 3. The receptacles 4 and 4' are disposed such that the receptacle 4 on one side of the longitudinal axis 3 is a transposed mirror image of the receptacle 4' on the other side of the longitudinal axis 3.

The receptacles 4 and 4' each include an outlet 5. The outlet 5 is nozzle shaped to allow a substance contained within the receptacle 4 to be easily evacuated from the receptacle 4. The outlet 5 is positioned on or adjacent the side edge of the web 2, distal from the longitudinal axis 3. It can be seen that when folded, the receptacle 4 on one side of the longitudinal axis 3 is substantially aligned with the receptacle 4' on the other side of the longitudinal axis 3.

The web 2 and receptacles 4 and 4' may be integral to one another or may be composed of separate materials and sealed or otherwise affixed to one another. The materials are flexible to allow a substance contained within receptacle 4 to be squeezed through outlet 5. The web may be composed of foil or polyethylene, polypropylene, polyvinyl chloride, polyvinyl acetate or foil coated with one of the plastics, specifically polypropylene. The receptacles 4 and 4' may similarly be composed of a foil or polyethylene, polypropylene, polyvinyl chloride, polyvinyl acetate or foil coated with on of the plastics, specifically polypropylene. The web 2 and receptacles 4 and 4' may comprise one or more laminae. The laminae may be composed of foil or polyethylene, polypropylene, polyvinyl chloride, polyvinyl acetate or foil coated with on of the plastics, specifically polypropylene or each lamina may be composed of a separate material. The laminae are then sealed together to form the receptacles 4 and 4'.

The receptacles 4 and 4' further include indicia or markings 6 to indicate where a user is to place his or her thumb and forefinger in order to evacuate a substance contained within receptacles 4 and 4' through outlet 5. The indicia 6 can be incorporated into the shape of the receptacles 4 and 4' or can be painted or printed thereon. It can be seen that these indicia 6 allow for a substantially complete evacuation of receptacle 4 through outlet 5. Moreover, it can be seen that the indicia 6 allow for easy one-handed use of the dispensing device 1.

Outlet 5 may include a weakened point or region (not illustrated). In use the substances contained within the two receptacles 4 and 4' will burst through the weakened region upon a user squeezing receptacle 4. Alternately, web 2 and outlet 5 can incorporate a scored or vacuum formed tear line 7. Tear line 7 may be double die-cut. The tear line 7 leads through the weakest point of outlet 5. It can be seen in FIGS. 4 and 5 that upon a user cutting or tearing along tear line 7, the seal on outlet 5 would be opened allowing the substances contained within the receptacles 4 to be evacuated by squeezing.

The substances contained within the two receptacles 4 and 4' in this embodiment may be an epoxy and a hardener, however any preferred substances can be used. In use it is important that proportional amounts of these substances be applied to a surface (not illustrated). In use the epoxy and hardener can be in the proportions 1:1, 1:2, 1:3, 1:4, 1:100 or any suitable proportions. The receptacles 4 and 4' can be molded to any predetermined size. When the receptacles 4 and 4' are of differing sizes the outlets 5 are still substantially aligned. It can be seen that in the present invention the proportion of the substances used is defined by the size of the receptacles 4.

In other embodiments the substances contained within the two receptacles 4 and 4' may be foodstuffs, pharmaceuticals, medical or dental products, beauty aids or any liquid, paste or gel substances designed for separate storage and simultaneous application. In use the receptacles 4 and 4' may be independently evacuated such that one or other of the two substances contained therein is dispensed.

The dispensing device 1 is designed to be used once and then disposed of. The dispensing device 1 can be sold in single application packs which comprise two receptacles 4 or in multiple application packs (not illustrated) where each pair of receptacles 4 corresponds to one application.

The dispensing device 1 may preferably have dimensions of approximately 60 mm by 45 mm. The receptacles 4 and 4' may preferably be approximately 7.5 mm in radius at their base (not illustrated) and approximately 5 mm in radius at their top (not illustrated). The outlets 5 may preferably taper to an end approximately 15 mm from the centre of the receptacles 4 and 4'. In this case the receptacles 4 and 4' contain between approximately 1 ml and approximately 5 ml of substance. However the receptacles 4 and 4' can be molded to contain any preferable volume of substance and may contain different amounts from one another.

The dispensing device 1 is adapted to be folded and manipulated by a user in a one-handed operation such that the outlets 5 are easily aligned and the substances contained within receptacles 4 and 4' are simultaneously dispensed, mixed and proportionately applied to a surface. In use the receptacles 4 and 4' extend outwardly once folded. In use the flat edges 8 of outlets 5 assist in mixing the two substances when they come into contact after application to the surface (not illustrated).

The foregoing describes only a preferred embodiment of the present invention and modifications, obvious to those skilled in the art, may be made thereto without departing from the scope of the present invention.

The term "comprising" (and its grammatical variations) as used herein is used in the inclusive sense of "having" or "including" and not in the exclusive sense "consisting only of".

The invention claimed is:

1. A one-use dispensing device for separately storing, dispensing, and applying proportional amounts of two substances, comprising:

a pair of spaced apart flexible receptacles disposed on a flat flexible thin web for each substance, each of said receptacles including a flat edge portion having an outlet therein;

a fold line extending over the flat flexible thin web and disposed equidistant between the receptacles;

wherein each of the receptacles has a circular base and a flat circular upper surface, wherein a diameter of the upper surface is smaller than a diameter at the base;

wherein said device being foldable about said fold line so that the receptacles are superimposed;

a pair of rupturable outlets each having a weakened region and an inlet, and each being in fluid communication with a respective one of said pair of receptacle outlets;

wherein a tear line extends in between and separates each one of said pair of inlets and respective one of said pair of receptacle outlets;

wherein said receptacle outlets converge towards the fold line; and wherein said receptacles include indicia indicating where a thumb and forefinger of a user should be positioned to allow for substantially complete evacuation of the receptacle through the receptacle outlet;

whereby when the device is folded about said fold line, said receptacle outlets and said rupturable outlets are superposed, respectively, for dispensing and mixing the substances when the receptacles are squeezed; and whereby the device is configured to be manipulated by a user in a one-handed operation to dispense the two substances.

2. A dispensing device as defined in claim 1, wherein said receptacles are disposed such that one of said receptacles on one side of the fold line is a transposed mirror image of the other receptacle on the other side of the fold line and said receptacles are substantially equidistant from the fold line.

3. A dispensing device as defined in claim 1, wherein said device comprises two flexible laminae positioned adjacent one another and sealed together so as to define said two receptacles.

4. A dispensing device as defined in claim 3, wherein the laminae are selected from a group comprising foil, polyethylene, polypropylene, polyvinyl chloride, polyvinyl acetate and foil coated with polypropylene.

5. A dispensing device as defined in claim 3, wherein each of the laminae are composed of different materials.

6. A dispensing device as defined in claim 1, wherein upon said substances being squeezed from said device and meeting, said substances undergo a chemical or physical reaction.

7. A dispensing device as defined in claim 1, wherein one of said two receptacles contains an epoxy and the other of said two receptacles contains a hardener.

8. A dispensing device as defined in claim 1, wherein the receptacles contain foodstuffs.

9. A dispensing device as defined in claim 1, wherein the receptacles contain materials selected from a group comprising pharmaceuticals, other liquids, pastes and gels used in medical or dental work.

10. A dispensing device as defined in claim 1, wherein said device is adapted to be folded and manipulated by a user in a one-handed operation such that said receptacle outlets are easily aligned and said substances contained within said receptacles are simultaneously dispensed, mixed and proportionately applied.

11. A dispensing device as defined in claim 1, wherein said outlets are positioned at or adjacent to the side edges of the dispensing device.

12. The dispensing device according to claim 1, wherein the two substances are epoxy and a hardener.

13. A dispensing device as defined in claim 12, wherein said device is adapted to be folded and manipulated by a user in a one-handed operation such that the receptacle outlets are easily aligned and the epoxy and hardener are simultaneously dispensed, mixed and proportionately applied.

14. A dispensing device as defined in claim 1, wherein said receptacle outlets are disposed such that one of said receptacle outlets on one side of the fold line is a transposed mirror image of the other outlet on the other side of the fold line and said receptacle outlets are substantially equidistant from the fold line of fold, whereby the substances are dispensed and mixed when the receptacles are squeezed.

15. A dispensing device as defined in claim 1, wherein the receptacles are approximately 7.5 mm in radius at their base and approximately 5 mm at their top.

* * * * *